United States Patent [19]

Castillo

[11] 4,140,245

[45] Feb. 20, 1979

[54] RECIRCULATING CARBONATOR AND LIQUID LEVEL CONTROL

[75] Inventor: Herman B. Castillo, Clawson, Mich.

[73] Assignee: Alco Foodservice Equipment Company, Miami, Fla.

[21] Appl. No.: 784,225

[22] Filed: Apr. 4, 1977

[51] Int. Cl.[2] ..... B67D 5/56

[52] U.S. Cl. ..... 222/56; 137/386; 222/64; 222/129.1; 222/318

[58] Field of Search ..... 222/56, 57, 64, 67, 222/145, 318, 129.1, 129.2; 137/386, 409, 434, 565

[56] References Cited

U.S. PATENT DOCUMENTS

| | | | |
|---|---|---|---|
| 3,394,847 | 7/1968 | Garrard | 222/56 |
| 3,575,533 | 4/1971 | Bubula | 137/386 X |
| 3,731,845 | 5/1973 | Booth | 222/67 |
| 3,809,292 | 5/1974 | Booth et al. | 222/146 C |

*Primary Examiner*—Stanley H. Tollberg
*Assistant Examiner*—Fred A. Silverberg
*Attorney, Agent, or Firm*—Haight, Hofeldt, David & Jambor

[57] ABSTRACT

A recirculating carbonator and beverage dispenser requires only one pump. The system's function can be enhanced by the use of a two position spool valve having a fresh water inlet port, a carbonated water inlet port, and a fluid outlet port commonly connected with a central bore. A spool member is slidably disposed within the bore to selectively interrupt fluid communication between the carbonated water inlet port and the liquid outlet port during the presence of a low water signal generated by a level sensing device within the system's carbonation tank. During the interruption, fresh make-up water is added to the system. The level sensing device includes a body with a longitudinal bore therethrough, an inlet for the constantly flowing fluid, and a venturi tube depending from the body.

5 Claims, 4 Drawing Figures

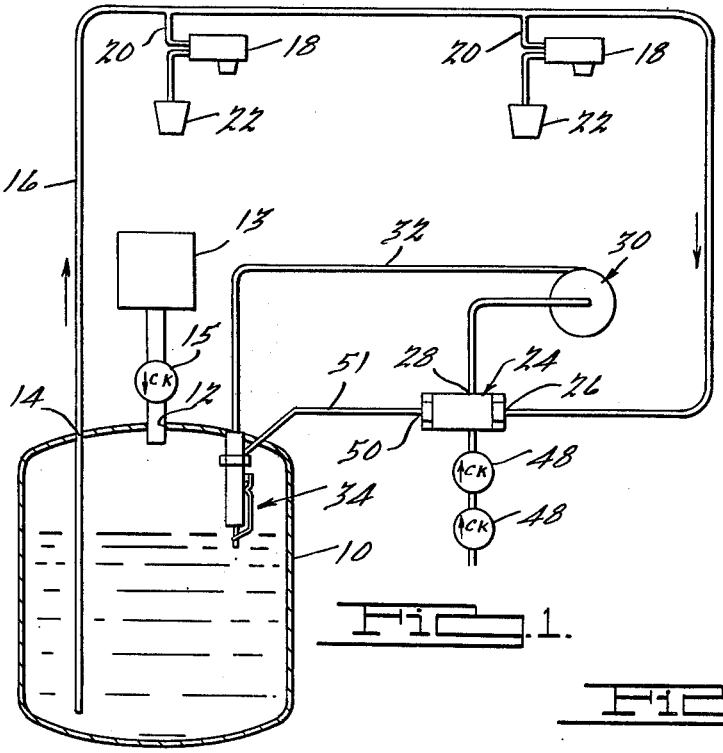
Fig. 1.
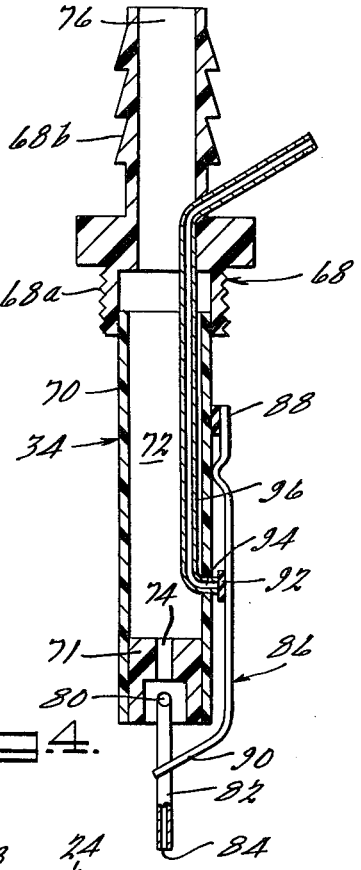
Fig. 4.
Fig. 2.
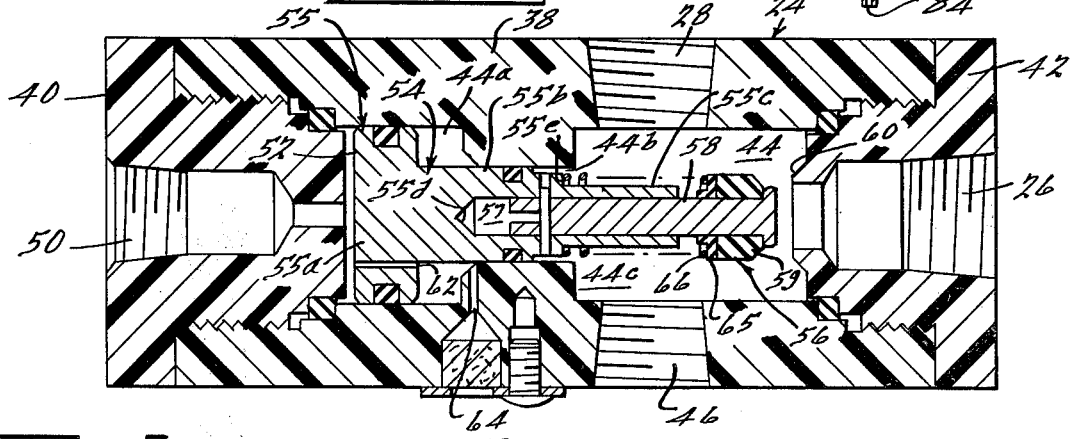
Fig. 3.
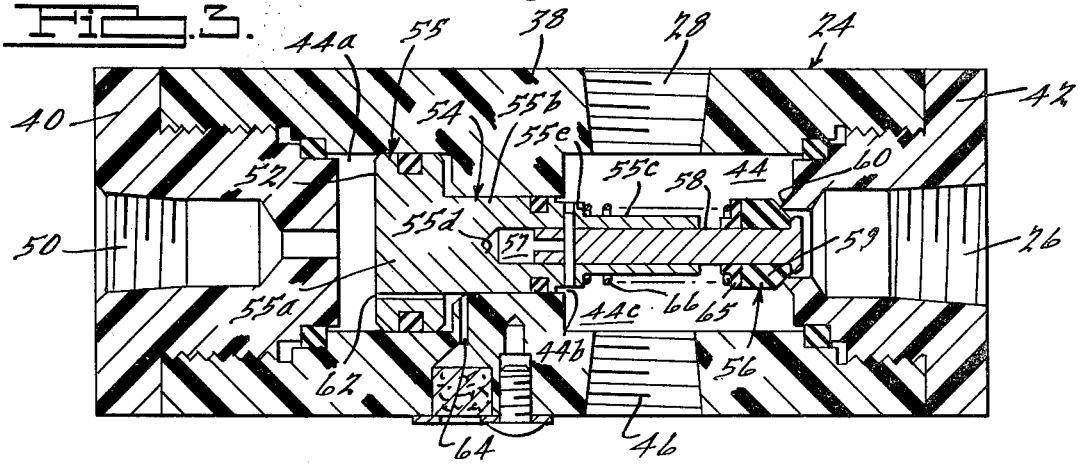

RECIRCULATING CARBONATOR AND LIQUID LEVEL CONTROL

BACKGROUND OF THE INVENTION

1. Field of the Invention

In one aspect, this invention relates to carbonator systems.

In a further aspect, this invention relates to liquid level controls used in carbonated beverage systems and which require the admission of fresh makeup water to the system.

2. Description of the Prior Art

Present recirculating carbonator systems constantly draw carbonated water from a storage tank, cycle the water past a beverage dispensing head into a pump, and return the water to the storage tank in a closed loop. Such systems normally use two pumps. One pump is used to recirculate the carbonated water throughout the system, and the second pump is used to force makeup fresh water into the storage tank for carbonation. The use of two pumps adds additional expense and maintenance problems to the present recirculating system. In general, various electrical and mechanical systems have been combined with the dispensers to signal that the liquid in the storage tank has been depleted and to activate the second pump to force makeup water into the system. The electrical systems require expensive electrical circuitry and the mechanical systems are not as reliable as desired.

To overcome this problem, a one pump recirculating system was developed. This existing single pump recirculating system utilizes a double diaphragm valve which is spring biased to stay in an open position allowing recirculation during the normal circulating cycle. The valve is closed by means of a fluid amplifier when the liquid level in the storage tank falls below a predetermined level. This momentarily stops the carbonated water recirculation and the recirculating pump draws fresh water into the system through a check valve. The action of the double diaphragm valve is dependent upon the use of the fluid amplifier which channels the carbonated water recycled into the storage tank into a port which is in fluid communication with one side of the diaphragm.

This system depends on a signal generated by a stream of carbonated water directed into an open circuitous passage of the liquid level sensor to activate the diaphragm valve; the valve is then rather insensitive to changes in liquid level within the storage chamber. Also, the activating force can be affected by the line pressure of fresh water to be admitted to the system, such pressures having a wide variation on the order of 20 to 60 psi.

SUMMARY OF THE INVENTION

It is an object of this invention to provide a recirculating system which is less expensive and more maintenance-free than prior art recirculating systems. It is a further object of this invention to provide a system which is relatively immune to variations in the water pressure in the external water source. A further object is to provide an improved single pump recirculating carbonator.

A feature of this system is the provision of a unique liquid lever sensing device adapted to cooperate with a recycling valve within a recirculating carbonator. The sensing device comprises a body with a longitudinal bore having an inlet which receives the constantly recycling carbonated water. The water passes through the bore and exits via an outlet. A venturi tube has a first end associated with the outlet through which the recycled water is exiting. The venturi tube has a second or intake end normally immersed in the carbonated water which is present in the reservoir common to recirculating dispensing systems. As the water passes by the venturi, the suction created at the first end draws water from the reservoir through the venturi. Sensing means attached to the body is adapted to sense when the flow of water past the venturi changes when the second intake end of the venturi tube is not immersed in carbonated water. The sensing means generates a signal which can then be used to activate the valve allowing additional fresh water to enter the system. In general, the signal generated is a carbon dioxide pressure.

BRIEF DESCRIPTION OF THE DRAWING

In the accompanying drawing:

FIG. 1 discloses schematically a single pump recirculating carbonation system;

FIG. 2 discloses one embodiment of a spool valve adapted to be used within the recirculating system of FIG. 1, the valve being shown in the recirculating mode;

FIG. 3 shows the valve of FIG. 2 in the fill mode; and

FIG. 4 discloses a liquid sensing device of this invention adapted to supply fluid pressure to the valve of FIGS. 2 and 3.

DETAILED DESCRIPTION OF THE DRAWING

Referring initially to FIG. 1 of the drawing, a tank 10 having an inlet 12 for carbon dioxide is used as a storage tank or reservoir for carbonating and storing water. A suitable carbon dioxide source 13 delivers carbon dioxide to a check valve 15 from whence it enters tank 10 through inlet 12. Carbonated water is withdrawn from the lower portion of tank 10 through a recirculating line 16 which exits tank 10 at outlet 14 and thereafter extends past one or more beverage dispensing heads 18. The beverage dispensing heads 18, when activated, will draw a quantity of carbonated water from the recirculating line 16 via a shunt 20 and simultaneously draw a quantity of beverage syrup from an attached syrup reservoir 22. The carbonated water is kept constantly circulating in line 16 at a constant pressure on the order of 80 to 125 psi. If no carbonated water is withdrawn by a beverage dispensing head, the carbonated water continues through line 16, and passes into the recycling inlet port 26 of a spool valve 24.

From the recycling inlet 26, carbonated water passes through an outlet 28 and into a pump 30, which acts to draw carbonated water through recirculating line 16. The pump 30 discharges the carbonated water from the pump outlet into a line 32 and into the storage tank 10. The carbonated water reentering the tank passes through a liquid sensing device 34 located within the tank.

It is understood that a cooling mechanism will be used to cool the water at some point as it travels through the recycling line 16. Such cooling mechanisms and their location are old in the art and form no part of this invention. One skilled in the art can easily locate a cooling system which will chill the carbonated water to the desired degree and a discussion of the chilling system is omitted in the interest of brevity.

The spool valve 24 is shown in greater detail in FIGS. 2 and 3. The valve body is constructed in three parts, a center valve body 38 and two end caps 40, 42 which are threaded into the center valve body to define within the center valve body a shaped longitudinal bore 44. End cap 42 defines the recirculating inlet 26. Water from the recirculating line 16 enters the shaped longitudinal bore 44 of the valve 24 at the recirculating inlet 26. The outlet 28 is deposed in center valve body 38 and provides an exit path from the bore 44 into the intake of pump 30. Liquid entering bore 44 is drawn into the pump and pumped into the storage tank 10. Also in fluid communication with bore 44 is a fresh water inlet 46 defined in center valve body 34 and connected via a double check valve 48 to a supply of city water (not shown). The pressure at the recycling inlet 26 normally runs between 80 and 125 psi or higher and the pressure at fresh water inlet 46 is normally about 20 to 40 psi. Therefore, when both inlets 26, 46 are open to the longitudinal bore 44, the higher pressure at the recycling inlet 26 will substantially prevent the influx of fresh water through inlet 46 and the valve can be said to be in a recycling mode as shown in FIG. 2.

At the opposite end of the valve body distal the recycling inlet is an actuation inlet 50 which is defined by end cap 40 and connected to the liquid level sensing means 34 by a line 51 (FIG. 1). A spool assembly 54 is disposed in bore 44. Assembly 54 includes a main body member 55 and a plunger 56. Main body member 55 includes an enlarged end portion **55*a* sealingly and slidably received in end portion 44*a* of bore 44, a central portion 55*b* slidably and sealingly received in a necked down bore portion 44*b*, and an end portion 55*c* disposed centrally within enlarged bore portion 44*c*. A central bore 57 extends through end portion 55*c* and terminates at a blind end 55*d* within central portion 55*b*. Plunger 56 is slidably received in bore 57**.

When the liquid level in storage tank 10 falls below a predetermined level, valve 24 is actuated by admitting an actuating fluid through the actuation inlet 50. The fluid pushes against the large end face 52 of valve assembly 54 and drives the plunger 56 into a seated or fill mode position as shown in FIG. 3.

Specifically, an annular sealing washer 59 which is positioned on the face end of plunger 56 moves into engagement with a valve seat 60 defined at the inboard end of recycling inlet 26. This effectively seals the recycling inlet 26 from the shaped longitudinal bore 44. In the fill mode, the pump 30 withdraws water from the longitudinal bore 44 and creates a sufficiently low pressure so that fresh water will enter the longitudinal bore 44 through fresh water inlet 46 and thereby the recirculating system. Fresh water will continue to enter until the liquid level sensing means 34 signals that the liquid level in the storage tank has been restored. At this point, the actuation is stopped and the pressure which was applied to the face 52 of the plunger bleeds through a small bore 62 longitudinally disposed through the face of the plunger and exits from the valve body via a channel 64.

The valve spool 54 is shown as being actuated by a fluid applied via the actuation port 50. Of course, the valve could be actuated by means of a rod or similar well known valve actuation means known in the art. Examples of well known mechanical actuation means are solenoids and mechanical linkages.

As shown, the annular radially disposed sealing washer 56 is biased into engagement with the seat 60 by means of a compression helical spring 66. Spring 66 seals at one end on a washer member 65 positioned on plunger 56 adjacent the inboard end of washer 56; the closed end of spring 66 seals adjacent a shoulder **55*e* defined on main body member 55. This particular sealing arrangement provides a means for controlling the water pressure at the dispensing head. As the storage tank 10 fills, carbon dioxide within the tank will be compressed by the water entering the tank. As the carbon dioxide pressure increases, the pressure in the recycling line 16 will correspondingly increase and the pressure at the recycling inlet 26 will rise to 120 psi or more. The spring 66 allows the annular sealing washer 56 to slightly disengage from the mating sealing surface 60 allowing a small quantity of water to leak into the bore 44 relieving the pressure while allowing filling to continue. This feature prevents excessive pressure build up in the recirculating line 16 which would affect the water to syrup ratio at the dispensing head. The pressure at which the spring 66** allows the annular sealing washer to partially release is a matter of choice and those skilled in the art can adjust the spring to provide the desired pressure in a particular system.

Referring to FIG. 4, a liquid level sensing device 34 of this invention is shown adapted to actuate the valve 24 of FIGS. 2 and 3. The sensing device 34 includes a connector 68 having a lower threaded fitting **68*a* for threaded engagement into the inlet of tank 10 and an upper serrated fitting 68*b* for receipt of line 32. A tube 70 is press fit into fitting 68*a* and extends downward therefrom into the storage tank. A plug 71 is fitted into the lower end of tube 70 and defines a restricted outlet 74. Recirculating fluid enters the bore through inlet 76 and passes through the restricted outlet or orifice 74 past the mouth 80 of a venturi tube 82. As the recirculating fluid passes the venturi tube 82, it creates an area of reduced pressure at the mouth 80 of the venturi tube 82. The other or liquid sensing end 84 of the venturi tube contacts the liquid contained within the storage tank. Fluid from the reservoir will be drawn through the venturi tube 82 and strike the stream of recirculating water as it leaves the restricted outlet 74. This deflects the recirculating stream as it passes the mouth 80 of the venturi 82. As shown, the liquid drawn through the venturi tube 82 will exit from the venturi tube perendicular to the plane of the drawing and will deflect the stream of recirculating fluid exiting from the restricted outlet 74** out of the plane of the drawing.

A cantilevered arm 86 is rigidly mounted at one end 88 to tube 70 of the sensor 34 and has a curved end 90 which projects into the straight-line path of the recirculating water when there is no water being drawn through the venturi pipe 82. A fluid tube 96 extends within tube 70; tube 96 projects at its upper end through fitting **68*b* for connection to line 51 and projects at its lower end through tube 70 for connection with arm 86. A sealing pad 92 located on the arm 86 normally blocks the entrance end 94 of tube 96. In general, the venturi pipe has its lower or terminus end 84 positioned so that when the storage tank has the desired quantity of carbonated water, the terminus end 84 of the pipe 82 is in the carbonated water. When the water level falls below the desired level, the terminus end of the venturi pipe will be in a carbon dioxide gaseous atmosphere. At this point, no liquid will be drawn through the venturi 82 by the recirculating water, and the recirculating water will strike the hooked end 90 of the cantilevered arm 86. The force of the recirculating water striking the arm will deflect the arm and move the pad 92 away from the inlet end 94 of the fluid tube 96. The $CO_2$ gas normally present in the storage chamber 10 under pressures of approximately 80 to 120 psi or higher will flow freely through the tube 96**. Gas exiting from the tube is used as a signal warning that the liquid level in the storage tank is inadequate.

In cooperation with the valve disclosed in FIGS. 2 and 3, $CO_2$ gas will be vented directly to the actuation inlet 50 where it will act on the plunger 54 moving the valve into the sealing position shown in FIG. 3.

As shown, the carbon dioxide pressure is used to activate the spool valve directly. Of course, it is understood that the carbon dioxide signal from the liquid level device of this invention can be used in various ways to activate a valve such as by closing a deformable switch or activating a pressure sensitive device.

Various modifications and alterations of this invention will become obvious to those skilled in the art without departing from the scope and spirit of this invention. It is to be understood that this invention is not limited to the illustrative carbonation embodiment disclosed hereinbefore.

What is claimed is:

1. Carbonation system comprising:

a. a carbonation tank operative to hold carbonated water and having an outlet and an inlet;

b. a closed loop carbonated water circuit connecting the outlet and the inlet of said tank;

c. dispensing means operative to withdraw carbonated water from said circuit and mix the withdrawn carbonated water with a beverage syrup;

d. a source of carbon dioxide adapted to furnish carbon dioxide to the carbonation tank at an elected pressure;

e. valve means for introducing fresh water into said tank in response to a carbon dioxide signal; and f. carbonated water level sensing means disposed within said tank and operative to communicate said carbon dioxide pressure signal to said valve means when the carbonated water within said tank is depleted below a predetermined level.

2. The system of claim 1, wherein, said level sensing means comprises:

a body having a longitudinal bore therethrough, an inlet adapted to receive constantly flowing liquid from said circuit, an outlet, a venturi tube normally partially immersed in a reservoir of liquid associated with said outlet, said constantly flowing liquid providing a constant aspiration through said tube; and arm means for communicating said pressure signal with said valve means when said venturi tube is not in contact with said reservoir.

3. The sensor of claim 2 wherein, said arm means comprises a cantilevered arm depending from said body, having a free end supportively retaining said venturi tube and operative to engage the stream of fluid from said outlet when the venturi action due to a low liquid level fails to draw liquid from the reservoir.

4. A liquid level sensor mounted in a reservoir of a system having a constantly recirculating liquid therein, said sensor comprising:

a body having a longitudinal bore therethrough, an inlet adapted to receive the constantly flowing liquid, an outlet, a venturi tube normally partially immersed in a reservior of liquid associated with said outlet, said constantly flowing liquid providing a constant aspiration through said tube; and arm means associated with said tube to sense when said aspiration through said tube does not draw liquid from said reservoir.

5. The sensor of claim 4 wherein, said arm means comprises a cantilevered arm depending from said body, having a free end supportively retaining said venturi tube and operative to engage the stream of fluid from said outlet when the venturi action due to a low liquid level fails to draw liquid from the reservoir.

* * * * *